US011317780B2

(12) United States Patent
Palmtag

(10) Patent No.: US 11,317,780 B2
(45) Date of Patent: May 3, 2022

(54) BATHROOM CLEANING DEVICE WITH REMOVABLE, WASHABLE AND REUSABLE HEAD AND METHOD OF USE

(71) Applicant: J.J. Palmtag, Inc., Nebraska City, NE (US)

(72) Inventor: Janet A. Palmtag, Nebraska City, NE (US)

(73) Assignee: J.J. Palmtag, Inc., Nebraska City, NE (US)

( * ) Notice: Subject to any disclaimer, the term of this patent is extended or adjusted under 35 U.S.C. 154(b) by 69 days.

(21) Appl. No.: 16/383,918

(22) Filed: Apr. 15, 2019

(65) Prior Publication Data

US 2019/0239713 A1 Aug. 8, 2019

Related U.S. Application Data

(63) Continuation-in-part of application No. 15/215,691, filed on Jul. 21, 2016, now Pat. No. 10,264,940.

(51) Int. Cl.

| | |
|---|---|
| ***A47L 13/253*** | (2006.01) |
| ***B08B 1/00*** | (2006.01) |
| ***A47L 13/16*** | (2006.01) |
| ***B25G 3/38*** | (2006.01) |

(52) U.S. Cl.
CPC ..... *A47L 13/253* (2013.01); *A47L 13/16* (2013.01); *B08B 1/006* (2013.01); *B25G 3/38* (2013.01)

(58) Field of Classification Search
CPC ..... A47L 13/253; A47L 13/16; B08B 1/006; B25G 3/38
See application file for complete search history.

(56) References Cited

U.S. PATENT DOCUMENTS

| | | | | |
|---|---|---|---|---|
| 2,987,745 | A | 6/1961 | Wallace | |
| 4,970,750 | A | 11/1990 | Davis, III | |
| 5,419,015 | A | 5/1995 | Garcia | |
| 5,575,032 | A | 11/1996 | Cernuska | |
| 5,609,255 | A | 3/1997 | Nichols | |
| 5,815,876 | A * | 10/1998 | Overseth | B24D 15/04 15/97.1 |
| 5,913,982 | A | 6/1999 | Phillips | |

(Continued)

*Primary Examiner* — Alexander Markoff
(74) *Attorney, Agent, or Firm* — Luke C. Holst; McGrath North Mullin & Kratz, PC LLO

(57) ABSTRACT

The present invention relates in general to the field of cleaning devices, and more specifically, to a cleaning device and method of cleaning bathrooms. The cleaning device and method of cleaning bathrooms is inexpensive and environmentally friendly in that it utilizes a removable, washable and reusable cleaning head to thereby reduce unnecessary waste and cost. The cleaning device and method of cleaning bathrooms is sturdy and allows a user to clean an entire bathroom including showers, bathtubs, sinks, counters and toilets. The cleaning head may also be used separate from the cleaning device to clean easy to reach places such as countertops, sinks and toilets. The cleaning head may be reversible wherein opposite sides of the cleaning head may utilize certain materials to better clean different areas of the bathroom. The purpose of the invention is to provide a cleaning device and method of cleaning bathrooms that reduces the risk of slipping, falling and injuries associated with traditional methods of cleaning bathrooms (e.g., neck, back, shoulder and knee pain).

18 Claims, 5 Drawing Sheets

(56) References Cited

U.S. PATENT DOCUMENTS 6,611,986 B1 9/2003 Seals
7,496,985 B1 3/2009 Morad
7,536,743 B2 5/2009 Coh et al.
7,552,499 B2 6/2009 James et al.
7,653,961 B2 * 2/2010 Probasco ..... A47L 1/15 15/210.1
8,601,631 B1 12/2013 Martin
9,247,856 B2 2/2016 Colangelo
10,264,940 B2 * 4/2019 Palmtag ..... A47L 13/257
2001/0044980 A1 11/2001 Duplessis
2002/0152569 A1 10/2002 Zorzo
2004/0117931 A1 6/2004 Washington et al.
2004/0184867 A1 9/2004 Wang
2004/0237240 A1 12/2004 Post
2005/0034260 A1 2/2005 Post
2005/0058500 A1 * 3/2005 Hall ..... A47L 13/312 401/140
2005/0155631 A1 7/2005 Kilkenny et al.
2005/0235446 A1 * 10/2005 Eggers ..... A47L 11/162 15/220.1
2006/0168748 A1 8/2006 Dotterman
2006/0168750 A1 8/2006 Dotterman
2006/0260078 A1 11/2006 Ranks
2007/0061987 A1 * 3/2007 Kresse ..... A47L 13/20 15/228
2007/0264075 A1 11/2007 Panasci et al.
2008/0115302 A1 5/2008 Kilkenny et al.
2009/0144923 A1 6/2009 Tuman
2010/0065082 A1 3/2010 Dinh
2013/0212822 A1 8/2013 Libman
2013/0291327 A1 11/2013 Perez
2014/0251844 A1 9/2014 Michelson et al.
2015/0040331 A1 2/2015 White
2015/0164297 A1 * 6/2015 Eisenhut ..... A47L 13/20 15/209.1
2016/0088927 A1 3/2016 Knight
2016/0206172 A1 7/2016 Pullen
2017/0225317 A1 8/2017 Cook
2018/0020897 A1 * 1/2018 Palmtag ..... A47L 13/12 134/6

* cited by examiner

BATHROOM CLEANING DEVICE WITH REMOVABLE, WASHABLE AND REUSABLE HEAD AND METHOD OF USE

CROSS REFERENCE TO RELATED APPLICATIONS

This application is a continuation in part of application Ser. No. 15/215,691, filed Jul. 21, 2016, herein incorporated by reference in its entirety.

FIELD OF THE INVENTION

The present invention relates in general to the field of cleaning devices, and more specifically, to a bathroom cleaning device and method of cleaning bathrooms. The purpose of the invention is to provide an environmentally-friendly bathroom cleaning device and method of cleaning bathrooms that utilizes a removable, washable and reusable cleaning head. An additional purpose of the invention is to provide a bathroom cleaning device and method of cleaning bathrooms that is sturdy, easy to operate and convenient to store.

BACKGROUND OF THE INVENTION

As the proverbial saying goes "cleanliness is next to godliness." Yet as anyone who has ever visited a bathroom in a college dormitory, truck stop or high school locker room can attest: cleanliness can be a difficult, if not an impossible task. Damp surfaces and warm temperatures in bathrooms provide ample breeding grounds for bacteria and viruses that may cause disease. Slippery surfaces, sharp corners and hard to reach places compound the difficulties in cleaning a bathroom. Traditional cleaning methods are labor intensive—usually involving an individual on their hands and knees with a soap bucket and a sponge—manually scrubbing floors, bathtubs, toilets and showers with good old fashioned elbow grease. Such strenuous methods have inherent problems and are prone to accidents, particularly for the elderly. For example, the soap or detergent may cause skin or allergic reactions to exposed skin. Manipulating around the bathroom on hard surfaces and in close quarters may create back, knee and/or neck pain. Slick surfaces may also create dangerous situations where an individual can easily lose their footing, resulting in additional injuries.

In an attempt to mitigate such risks, numerous tools have been developed to aid in the cleaning of bathrooms and to prevent injury—with varying degrees of success. For example, powered hand-held brushes have been fluidly attached to existing water fixtures (e.g., bathroom sink faucets, shower heads or bathtub faucets) and are configured to divert water away from the fixture and to the location being cleaned. However, such an apparatus is clumsy, bulky and does not alleviate the problems associated with traditional hand-held cleaning devices that facilitate slips, falls, knee, shoulder, neck and back pain. Another example of a popular cleaning implement is the SWIFFER® device. The mop head of the SWIFFER® device includes a support plate connected to a handle. In order to clean a flat surface, a user first must attach a disposable wet/dry cleaning sheet to a retaining structure located on the top surface of the mop head. The user may then wipe the flat surface with the disposable wet/dry cleaning sheet to clean the surface. While convenient, the SWIFFER® device's simple design is strictly limited to smooth, flat surfaces. Thus, it is unable to clean the entire bathroom—including curves, corners and uneven facades—typically encountered when cleaning showers, bathtubs, sinks, counters and toilets. Its design is also flimsy, thus, no significant amount of force can be applied by a user to eliminate hard-to-remove dirt and grime. Notably, the SWIFFER® device is expensive and environmentally irresponsible in that it utilizes multiple cleaning sheets that are disposed of after each use.

Thus, a desire remains to provide a cleaning device and method of cleaning that minimizes the risk of injuries associated with traditional methods of cleaning bathrooms. A desire also remains to provide a cleaning device and method of cleaning that is sturdy and allows a user to clean an entire bathroom including showers, bathtubs, sinks, counters and toilets. A further desire remains to provide a reusable cleaning device and method of cleaning that is inexpensive, environmentally-friendly and reduces unnecessary waste.

BRIEF SUMMARY OF THE INVENTION

Therefore, it is a principal object, feature, and/or advantage of the present invention to overcome the aforementioned deficiencies in the art and provide a bathroom cleaning device and method of cleaning bathrooms that minimizes safety concerns and risk of injury for the user, particularly for commercial housekeepers and the elderly.

Another object, feature, and/or advantage of the present invention is to provide a bathroom cleaning device and method of cleaning bathrooms that is sturdy and allows a user to apply significant force to eliminate hard-to-remove dirt and grime.

Yet another object, feature, and/or advantage of the present invention is to provide a bathroom cleaning device and method of cleaning bathrooms that maximizes efficiency, is easy to operate and convenient to store (e.g., under a bathroom sink).

A further object, feature, and/or advantage of the present invention is to provide a bathroom cleaning device and method of cleaning bathrooms that may be used to clean the entire bathroom including showers, bathtubs, sinks, counters and toilets.

A still further object, feature, and/or advantage of the present invention is to provide a bathroom cleaning device and method of cleaning bathrooms that may be used on curves, corners and uneven facades.

Another object, feature, and/or advantage of the present invention is to provide a bathroom cleaning device and method of cleaning bathrooms that is convenient to clean and maintain.

Yet another object, feature, and/or advantage of the present invention is to provide a bathroom cleaning device and method of cleaning bathrooms that is adjustable in length to accommodate users of varying heights and sizes.

A further object, feature, and/or advantage of the present invention is to provide a reusable bathroom cleaning device and method of cleaning bathrooms that is environmentally-friendly, lessens chemical usage and reduces unnecessary waste.

A still further object, feature, and/or advantage of the present invention is to provide a bathroom cleaning device and method of cleaning bathrooms that utilizes a removable, washable and reusable cleaning head.

Another object, feature, and/or advantage of the present invention is to provide a reusable bathroom cleaning device and method of cleaning bathrooms that is inexpensive, value-priced and thus affordable for the everyday consumer.

Yet another object, feature, and/or advantage of the present invention is to provide a bathroom cleaning device and method of cleaning bathrooms that may be used commercially in the housekeeping, hospital/hospice, retirement home and motel/hotel industries.

These and/or other objects, features, and/or advantages of the present invention will be apparent to those skilled in the art. The present invention is not to be limited to or by these objects, features, and advantages. No single aspect need provide each and every object, feature, or advantage.

According to one aspect of the present invention, a cleaning device for cleaning a bathroom is provided. The cleaning device comprises a handle attached to one end of an elongated arm and a baseplate rotatably connected to an opposite end. The cleaning device may transition from a retracted state to an extended state, and vice versa, utilizing telescoping extensions that aid a user in cleaning hard-to-reach bathroom areas. The cleaning device may comprise a removable, washable and reusable cleaning head attached to the baseplate. The cleaning head may be removably attached to the baseplate via a series of ends slidably and snugly fitted inside a series of pockets. In particular, the cleaning head may comprise an outer envelope and an inner cleaning substrate, wherein the inner cleaning substrate may be removable from the outer envelope. The outer envelope and inner cleaning substrate are configured to be conveniently washed by the user to restore cleanliness of the cleaning head. Thus, the cleaning device of the present invention may be reused repeatedly to save money for the user and reduce unnecessary waste as compared to other cleaning devices that utilize disposable wet/dry cleaning sheets.

According to another aspect of the present invention a method of cleaning a bathroom is provided. The method includes providing a bathroom and the bathroom cleaning device of the present invention. The method next comprises cleaning the bathroom using the cleaning device. The cleaning device may be adjusted into a retracted state or an extended state to clean hard-to-reach areas of the bathroom. The cleaning head may also be used separately and include at least two gripping loops to clean easy to reach places such as countertops, sinks and toilets. After cleaning the bathroom, the soiled cleaning head of the cleaning device may be detached, washed and used again to clean the bathroom. In particular, the inner cleaning substrate may be removed from the outer envelope and both items washed separately to optimally sanitize the cleaning head and promote faster drying. Once the inner cleaning substrate and the outer envelope have been sanitized and dried, the inner cleaning substrate may be re-inserted within the outer envelope. The sanitized cleaning head may then be reattached to the baseplate and reused in the future for cleaning the bathroom.

Different aspects may meet different objects of the invention. Other objectives and advantages of this invention will be more apparent in the following detailed description taken in conjunction with the figures. The present invention is not to be limited by or to these objects or aspects.

DESCRIPTION OF FIGURES

FIG. 1 is an isometric side view of the bathroom cleaning device of the present invention in a retracted state.

FIG. 2 is an isometric side view of the bathroom cleaning device of FIG. 1 in an extended state.

FIG. 3 is a close-up view of the cleaning head attached to the baseplate of the bathroom cleaning device of FIG. 2.

FIG. 4 is an exploded view of the cleaning head of the bathroom cleaning device of FIG. 3.

FIG. 5 is a flow chart of the method of cleaning a bathroom using the bathroom cleaning device of FIG. 1.

DETAILED DESCRIPTION OF THE INVENTION

Figure 1:
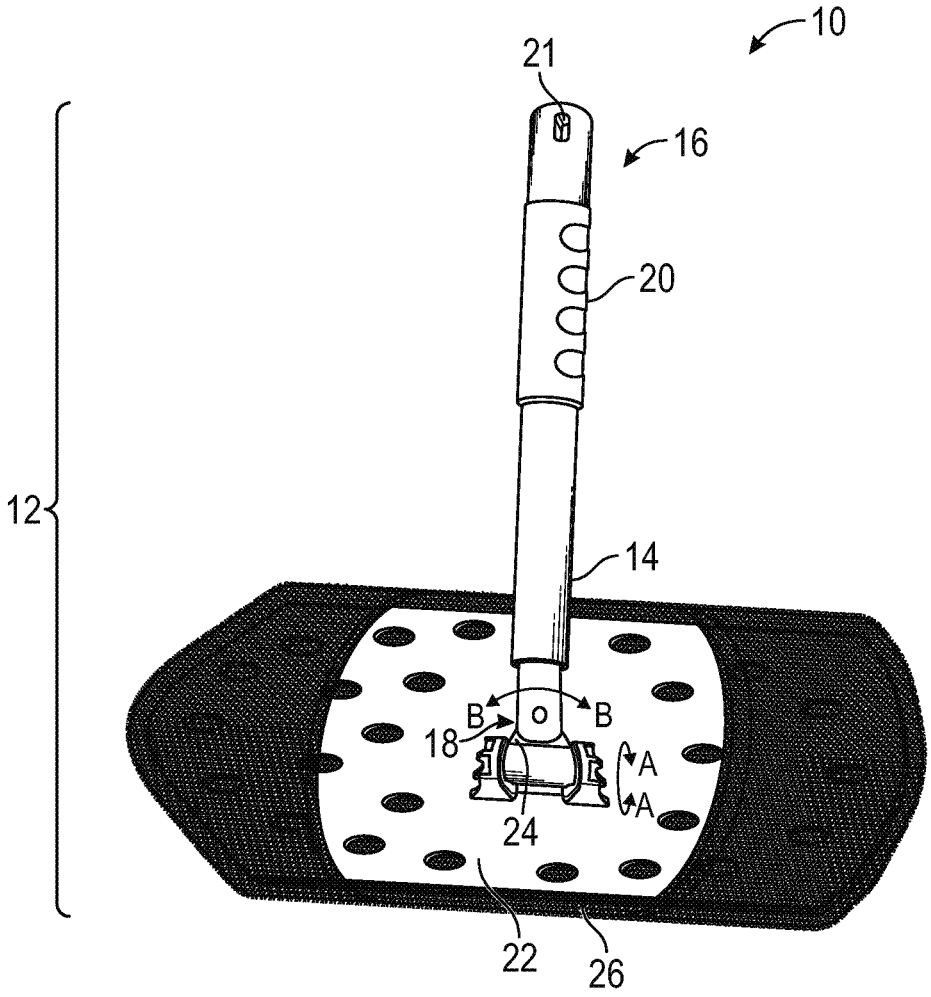
FIGS. 1-5 represent examples of bathroom cleaning devices of the present invention, and a method of cleaning a bathroom using the cleaning device of the present invention.

FIG. 1 illustrates an isometric side view of one aspect of a cleaning device (10) of the present invention for cleaning bathrooms, wherein the cleaning device (10) is in a retracted state (12). In the retracted state (12), the cleaning device (10) may have a predetermined overall length of approximately 15 in.-30 in. The retracted state (12) enables the cleaning device (10) to be handily and conveniently stored by a user in an easily accessible locale such as under a bathroom sink. The retracted state (12) may also be used while cleaning confined, close quarters (e.g., small bathrooms). The cleaning device (10) may be constructed of sturdy, light-weight and rust-resistant aluminum, steel, metal(s), wood(s), ceramic(s), rubber(s), plastic(s) and/or combinations thereof. Thus, a significant amount of force may be applied by the user to the cleaning device (10) in order to eliminate hard-to-remove dirt and grime.

Shown in FIG. 1, the cleaning device (10) may comprise an elongated arm (14). The elongated arm (14) may comprise a proximal end (16) and a distal end (18). Attached to the proximal end (16) of the elongated arm (14) is a handle (20). The handle (20) may include plastic(s), rubber(s), wood(s), foam(s), groove(s), hand-grip(s), strap(s) or any other component that will aid the user in gripping onto the elongated arm (14) while operating the cleaning device (10). The handle (20) may further include a loop, aperture, hook, strap or other suitable means (21) for permitting the user to hang the cleaning device (10) onto a cleaning cart, nail, overhang or other suitable storage during nonuse.

Further shown in FIG. 1, the cleaning device (10) may comprise a baseplate (22) attached to the distal end (18) of the elongated arm (14). The baseplate (22) may be formed of lightweight, rigid and nonabsorbent material. Non-limiting examples may include rust-resistant aluminum, metal(s), wood(s), ceramic(s), glass, rubber(s), plastic(s) and/or combinations thereof. The baseplate (22) may have a concave first end and an opposite triangular end with rounded corners (e.g., FIG. 1). It is contemplated that other baseplate (22) shapes may also be utilized by the present invention such as rectangular, circular, oval, square, triangular, pentagonal, octagonal and others. The baseplate (22) may be approximately 1/64-2 inches in thickness and include a width of approximately 2-12 inches and a length of approximately 6-36 inches.

Further shown in FIG. 1, the baseplate (22) may be rotatably connected to the distal end (18) of the elongated arm (14) via a joint (24). The joint (24) may comprise a 4-way swivel, a ball-and-socket joint or other pivoting means common in the industry. The joint (24) may be attached to the baseplate (22) and distal end (18) of the elongated arm (14) using adhesives, welds, glues, hot melts, solvents, integral construction, screws, bolts or any method known in the art. The means of attaching the joint (24) to the baseplate (22) and the distal end (18) of the elongated arm (14) shall not constrict freedom of movement of the joint (24), the joint (24) having at least a first rotational axis A-A and a second rotational axis B-B. It is contemplated that the joint (24) may include other rotational axes in addition to axes A-A and B-B.

Yet further shown in FIG. 1, the cleaning device (10) may comprise a removable, washable and reusable cleaning head (26) attached to the baseplate (22). Optionally, the cleaning head (26) may also be used separately to clean bathroom counter tops, sinks, toilets, etc. To assist when using separately, the cleaning head (26) may include at least two gripping loops to keep the cleaning head (26) in place on a user's hand while cleaning and to enable firm control. The gripping loops may be comprised of elastic or non-elastic fabric materials and may be integrally formed with the cleaning head (26) or may be affixed separately (e.g., sewn, stitched, glued, heat-sealed or any other method known in the art). In particular, a first gripping loop may be configured to extend snugly around a user's thumb of the right hand (the "right-hand thumb loop") while a user is cleaning the bathroom with the cleaning head (26) using the right hand. A second gripping loop may be configured to extend snugly around a user's thumb of the left hand (the "left-hand thumb loop") while a user is cleaning the bathroom with the cleaning head (26) using the left hand. The first and second gripping loops may be the same size in diameter or varying sizes to better fit a user's thumbs. The first and second gripping loops may be located on a dorsal surface of the cleaning head (26). Specifically, the right-hand thumb loop may be located opposite the left-hand thumb loop across the width of the cleaning head (26).

The cleaning head (26) is designed to simplify and improve the efficiency and ease of cleaning hard bathroom surfaces. The cleaning head (26) may comprise deformable materials that have the ability to conform to and around curved surfaces such as bathroom sinks, water fixtures, toilet bowls, counter tops, baseboards, showers and/or bathtubs. The cleaning head (26) may comprise accessories (not shown) such as bristles, a scrubber, a squeegee, a scraper or other tools for cleaning difficult areas. The cleaning head (26) may be absorbent and further impregnated with a disinfectant, cleaner or deodorizing material (e.g., soaps, detergents) that are released during use when the cleaning head (26) is wet. After use, the soiled cleaning head (26) may be detached from the baseplate and conveniently washed by the user to restore its cleanliness. For example, the user may hand wash or utilize a home/commercial washing machine to sanitize the cleaning head (26). After the cleaning head (26) has been sanitized, it may be reattached to the baseplate (22) and reused. Thus, the cleaning device (10) of the present invention is environmentally friendly in that it reduces unnecessary wastes and costs associated with other cleaning devices that utilize disposable wet/dry cleaning sheets.

Figure 2:
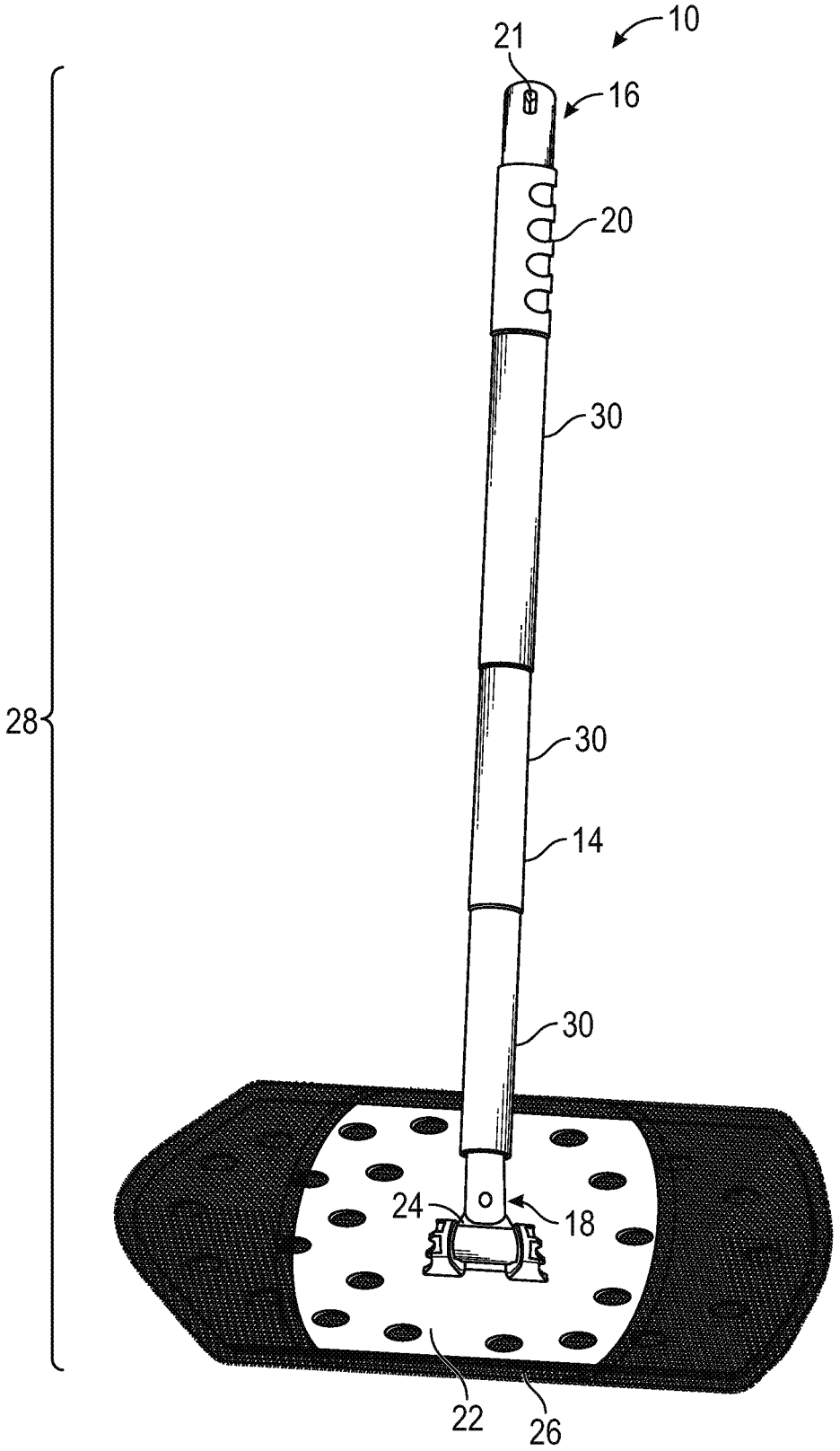

FIG. 2 illustrates an isometric side view of another aspect of the cleaning device (10) of the present invention for cleaning bathrooms, wherein the cleaning device (10) is in an extended state (28). In the extended state (28), the cleaning device (10) may have a predetermined overall length of approximately 3 ft.-5 ft. The extended state (28) may be used in open quarters to provide additional reach for difficult areas (e.g., large bathrooms, ceilings, walls, floors, inside and around showers and/or bathtubs). The cleaning device (10) may transition from the retracted state (12, FIG. 1) to the extended state (28, FIG. 2), and vice versa, utilizing an elongated arm (14) that is extendable and/or adjustable in length. In particular, the elongated arm (14) may comprise telescoping extensions (30) or other extension means common in the industry. The extended state (28) aids the user in cleaning hard-to-reach bathroom areas without requiring ladders and/or stools that commonly create dangerous situations where the user can easily lose their footing and result in injury. The extended state (28) may also aid the user in cleaning hard-to-reach bathroom areas without requiring the user to bend, twist or manipulate around the bathroom on hard surfaces to minimize back, knee and/or neck pain. The extended state (28) may also provide extra leverage when applying the requisite force to eliminate hard-to-remove dirt and grime.

Figure 3:
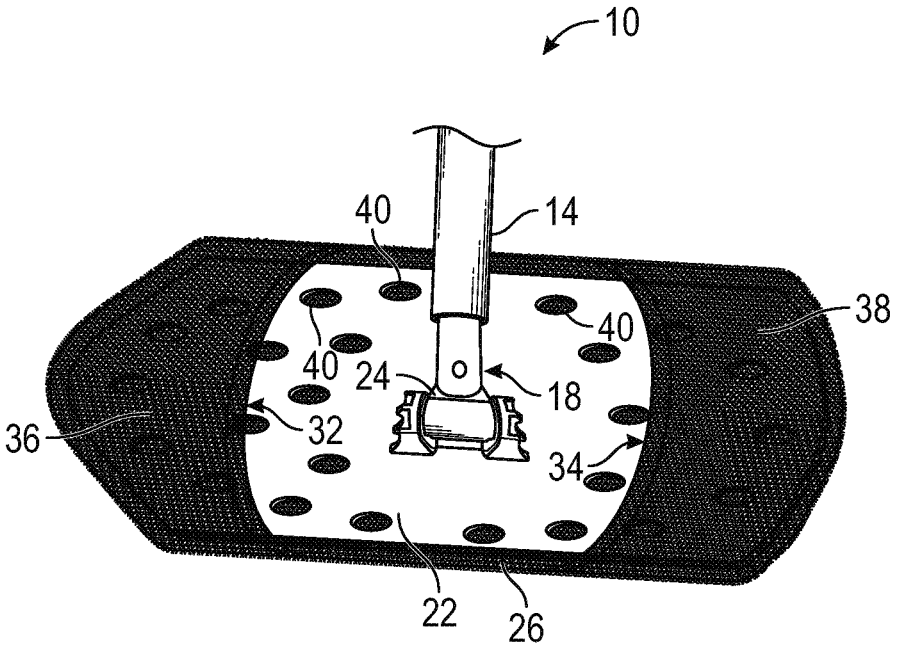

FIG. 3 illustrates a close-up view of another aspect of the cleaning device (10) of the present invention for cleaning bathrooms, wherein the cleaning head (26) is attached to the baseplate (22) of the cleaning device (10). In particular, the cleaning head (26) may comprise a first pocket (32) located at one end of the cleaning head (26) and a second pocket (34) located at an opposite end of the cleaning head (26). The first and second pockets (32, 34) may be located on a dorsal surface of the cleaning head (26). The first and second pockets (32, 34) may be integrally formed with the cleaning head (26) or may be affixed separately (e.g., sewn, stitched, glued, heat-sealed or any other method known in the art). The baseplate (22) may comprise a first end (36) and a second end (38) located opposite the first end (36) of the baseplate (22). The first and second ends (36, 38) may be integrally formed with the baseplate (22) or may be affixed separately (e.g., glued, welded, hot melted, screwed, bolted, heat-sealed or any other method known in the art).

Shown in FIG. 3, the first end (36) of the baseplate (22) is configured to slidably and snugly fit inside the first pocket (32) of the cleaning head (26). Similarly, the second end (38) of the baseplate (22) is configured to slidably and snugly fit inside the second pocket (34) of the cleaning head (26). The first and second pockets (32, 34) may incorporate elastic material to aid the pockets in retaining their shape, to prevent stretching and to help retain the first and second ends (36, 38) inside their respective pockets (32, 34). Thus, the first end (36) of the baseplate (22) fitted inside the first pocket (32) of the cleaning head (26)—in cooperation with the second end (38) of the baseplate (22) fitted inside the second pocket (34) of the cleaning head (26)—effectively attaches the cleaning head (26) to the ventral surface of the baseplate (22). The cleaning head (26) may be removed from the baseplate (22) by slidably removing the first and second ends (36, 38) of the baseplate (22) from their respective first and second pockets (32, 34) of the cleaning head (26). It is contemplated that additional ends and pockets may also be utilized by the present invention. Alternatively, the cleaning head (26) may be removably attached to the baseplate (22) utilizing a VELCRO® type system wherein the dorsal surface of the cleaning head (26) and the ventral surface of the baseplate (22) have a plurality of small hooks and/or loops that can removably attached together. Any other appropriate means for removably attaching the cleaning head (26) to the baseplate (22) may also be utilized, such as temporary adhesives, snaps, slots, straps, ties or loops.

Further shown in FIG. 3, the baseplate (22) may comprise a plurality of apertures (40) traversing through the baseplate (22) (i.e., made or formed through the whole thickness of the baseplate (22)). The plurality of apertures (40) permit liquids (e.g., water, cleaning chemicals, soap) to pass through the baseplate (22) to remove excess liquid while the bathroom cleaning device (10) is in use. An advantage of the plurality of apertures (40) traversing through the baseplate (22) is to allow the liquids to be absorbed and expelled easily from the cleaning head (26) and through the baseplate (22) while the bathroom cleaning device (10) is in use. Thus, the plurality of apertures (40) eliminate having to use an ancillary mop and/or bucket filled with soapy water and chemicals. Instead, any water faucet located in the bathroom may be conveniently used to reload and refresh liquid absorbed in the cleaning head (26). The plurality of apertures (40) may also facilitate faster drying of the cleaning head (26) attached to the baseplate (22) when the bathroom cleaning device (10) is not in use. The plurality of apertures (40) may have any geographic shape known in the art such as circular, oval, square, rectangular, triangular, pentagonal, octagonal and others and still provide the same benefits.

Figure 4:
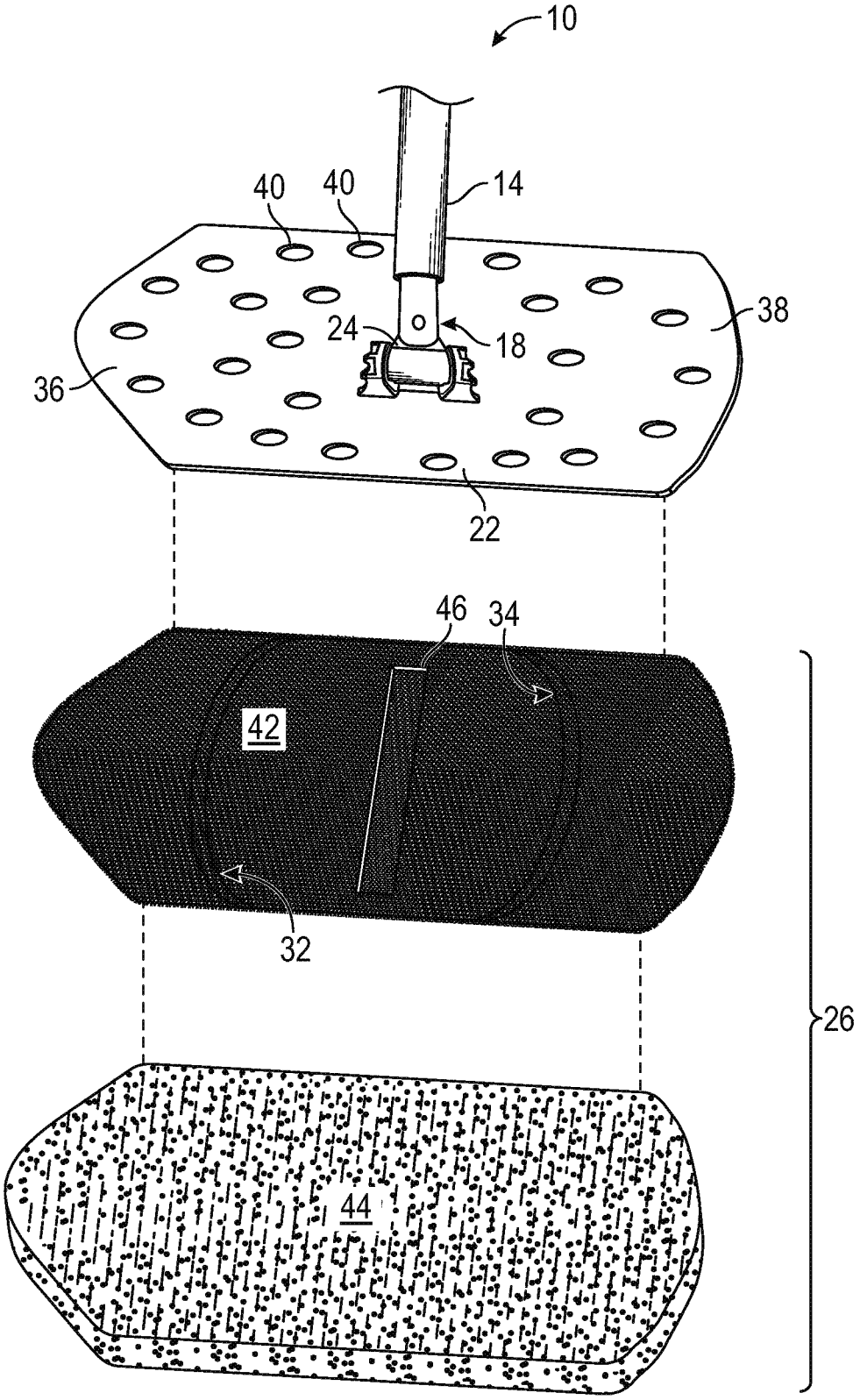

FIG. 4 illustrates an exploded view of another aspect of the cleaning head (26) of the cleaning device (10) of the present invention for cleaning bathrooms. In particular, the cleaning head (26) comprises an outer envelope (42) and an inner cleaning substrate (44). The outer envelope (42) may further include a slot or opening (46) on the dorsal surface of the cleaning head (26). The slot or opening (46) may be used to insert, remove and/or replace the inner cleaning substrate (44) from within the outer envelope (42) of the cleaning head (26). Alternatively, the inner cleaning substrate (44) may be integrally formed and sealed within the outer envelope (42) of the cleaning head (26). In particular, the outer envelope (42) may comprise nonwoven or woven fabrics that include cotton, microfiber, bamboo, hemp or combinations thereof useful for removing particulate matter and stains (e.g., dust, dirt, crumbs, hair, lint, grime, allergens, etc.) from a hard bathroom surface. The inner cleaning substrate (44) may comprise an anti-microbial sponge or foam useful for trapping and absorbing the aforementioned particulate matter and stains, including liquids, from a hard bathroom surface. Both the outer envelope (42) and the inner cleaning substrate (44) of the cleaning head (26) are configured to absorb liquids rapidly and dry quickly. Moreover, both the outer envelope (42) and the inner cleaning substrate (44) are deformable and compressible, thus, maintaining the ability of the cleaning head (26) to conform to and around curved surfaces such as bathroom sinks, water fixtures, toilet bowls, showers and/or bathtubs while cleaning the bathroom.

There may be provided multiple versions of the cleaning head (26) to be used with the cleaning device (10) of the present invention, wherein each version of the cleaning head (26) may comprise a unique material or combination of materials (e.g., nonwoven or woven fabrics, cottons, microfibers, bamboos, hemps, anti-microbial sponges, foams, bristles, scrubbing pads (e.g., light, medium or heavy duty), scouring pads, polishing covers, stripping pads, squeegees, scrapers or combinations thereof with optional impregnated disinfectants, cleaners, deodorizers, soaps and/or detergents) and be configured to optimally clean and focus on a different area of the bathroom. For example, a first version of the cleaning head (26) may incorporate a squeegee and/or a light duty scrubbing pad for optimally cleaning mirrors/glass. A second version of the cleaning head (26) may incorporate a scraper for optimally cleaning flat surfaces. A third version of the cleaning head (26) may incorporate a heavy duty scrubbing pad for optimally cleaning areas of the bathroom that require vigorous cleansing. The multiple versions of the cleaning head (26) may be exchangeable and configured to be used on the same baseplate (22) of the cleaning device (10). The specific examples of versions of the cleaning head (26) described above are non-limiting, as it is contemplated by the present invention that many different combinations of materials may be utilized to create additional versions of the cleaning head (26) for optimally cleaning other areas of the bathroom.

The cleaning head (26) may also be configured to be reversible for cleaning and focusing on different areas of the bathroom. For example, a first side of the cleaning head (26) may comprise a heavy duty scrubbing pad for optimally cleaning areas of the bathroom that require vigorous cleansing. An opposite, second side of the cleaning head (26) may comprise a light duty scrubbing pad for optimally cleaning mirrors/glass. The cleaning head (26) may be configured to be reversible by turning the first and second pockets (32, 34) inside-out to form new first and second pockets (32, 34). The first end (36) of the baseplate (22) may then be fitted inside the new first pocket (32)—in cooperation with the second end (38) of the baseplate (22) fitted inside the new second pocket (34)—to effectively attach the cleaning head (26) that has been reversed to the ventral surface of the baseplate (22). In this manner a user may utilize the first side of the cleaning head (26) (i.e., comprising the heavy duty scrubbing pad) when cleaning areas of the bathroom that require heavy cleaning, and then conveniently remove, reverse and re-attach the cleaning head (26) to the baseplate (22) to utilize the second side of the cleaning head (26) (i.e., comprising the light duty scrubbing pad) when cleaning mirrors/glass, and vice versa to switch back and forth between alternate sides of the cleaning head (26) depending on which areas of the bathroom require cleaning. Thus, a user may utilize a single, reversible cleaning head (26) for cleaning different areas of the bathroom without having to purchase separate alternative versions of the cleaning head (26). The specific examples of first and second sides of the cleaning head (26) described above are non-limiting, as it is contemplated by the present invention that many different combinations of materials may be utilized on either side of the cleaning head (26) for optimally cleaning particular areas of the bathroom.

After cleaning the bathroom and as mentioned previously, the soiled cleaning head (26) may be detached from the baseplate and conveniently washed using a home/commercial washing machine or a hand washing technique for sanitization purposes. In particular, the inner cleaning substrate (44) may be removed from the outer envelope (42) via the slot (46) and both items washed separately to optimally sanitize the cleaning head (26) and promote faster drying. Alternatively, the inner cleaning substrate (44) may be left inside the outer envelope (42) and both items washed together for convenience sake. Once the inner cleaning substrate (44) and outer envelope (42) have been sanitized and dried, the inner cleaning substrate (42) may be re-inserted within the outer envelope (42) via the slot (46). The cleaning head (24) may then be reattached to the baseplate (22) and reused for cleaning the bathroom. If either the inner cleaning substrate (44) or the outer envelope (42) wears out from repeated use, the deteriorated item may be replaced without having to purchase an entirely new cleaning head (24). Thus, the reusable cleaning device (10) of the present invention saves money for the user, reduces waste and is environmentally friendly as compared to other cleaning devices that utilize disposable wet/dry cleaning sheets.

Figure 5:
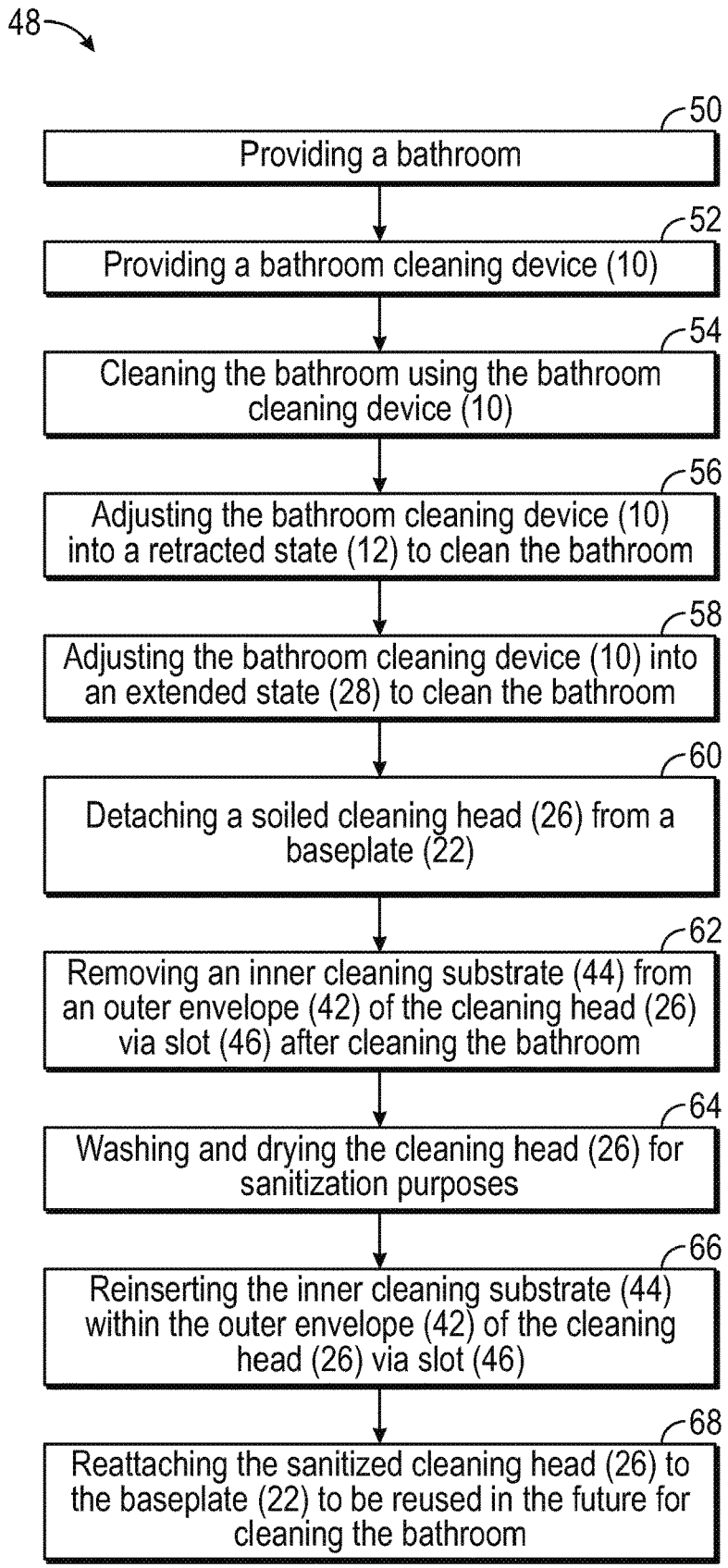

FIG. 5 illustrates another aspect of the present invention, a method (48) of cleaning bathrooms using the cleaning device (10) of the present invention. The method (48) comprises providing (50) a bathroom (e.g., public, household, business, etc.). The method (48) further comprises providing (52) a bathroom cleaning device (10) of the present invention as described supra and illustrated in FIGS. 1-4. The method (48) next comprises cleaning (54) the bathroom using the cleaning device (10). In particular, the elongated arm (14) of the cleaning device (10) may be adjusted (56) into a retracted state (12) to clean close quarters of the bathroom (e.g., small bathrooms). The method (48) may also include adjusting (58) the elongated arm (14) of the cleaning device (10) into an extended state (28) to clean open quarters of the bathroom (e.g., large bathrooms, ceilings, walls, floors, inside and around showers and/or bathtubs).

The soiled cleaning head (26) of the cleaning device (10) may be detached (60) from the baseplate (22) by slidably removing the first and second ends (36.38) of the baseplate (22) from their respective first and second pockets (32, 34) of the cleaning head (26). There may be provided multiple versions of the cleaning head (26) to be used with the cleaning device (10) of the present invention, wherein each version of the cleaning head (26) is exchangeable with the other and may comprise a unique material or combination of materials and configured to optimally clean and focus on a different area of the bathroom, as further detailed above. Alternatively or in addition to, the cleaning head (26) may be reversed and used for cleaning and focusing on different areas of the bathroom, as also detailed above.

The cleaning head (26) may be used separately to clean easy to reach places such as bathroom counter tops, sinks, toilets, etc. To assist when using separately, the cleaning head (26) may include at least two gripping loops to keep the cleaning head (26) in place on a user's hand while cleaning and to enable firm control. The gripping loops may be comprised of elastic or non-elastic fabric materials and may be integrally formed with the cleaning head (26) or may be affixed separately (e.g., sewn, stitched, glued, heat-sealed or any other method known in the art). In particular, a user may insert his/her thumb of the right hand into the first gripping loop (the "right-hand thumb loop"), wherein the right-hand thumb loop may be configured to extend snugly around a user's thumb of the right hand while a user is cleaning the bathroom with the cleaning head (26) using the right hand. Alternatively, a user may insert his/her thumb of the left hand into the second gripping loop (the "left-hand thumb loop"), wherein the left-hand thumb loop may be configured to extend snugly around a user's thumb of the left hand while a user is cleaning the bathroom with the cleaning head (26) using the left hand. The first and second gripping loops may be the same size in diameter or varying sizes to better fit a user's thumbs. The first and second gripping loops may be located on a dorsal surface of the cleaning head (26). Specifically, the right-hand thumb loop may be located opposite the left-hand thumb loop across the width of the cleaning head (26). Thus, the user may clean the bathroom separately using the cleaning head (26) with either hand for cleaning easy to reach places such as bathroom counter tops, sinks, toilets, etc.

After cleaning the bathroom, the inner cleaning substrate (44) may be removed (62) from the outer envelope (42) via the slot (46) and both items washed (64) separately to optimally sanitize the cleaning head (26) and promote faster drying. Alternatively, the inner cleaning substrate (44) may be left inside the outer envelope (42) and both items washed (64) together for convenience sake. The inner cleaning substrate (44) and outer envelope (42) of the cleaning head (26) may be conveniently washed using a home/commercial washing machine or a hand washing technique for sanitization purposes. Once the inner cleaning substrate (44) and the outer envelope (42) have been sanitized and dried, the inner cleaning substrate (44) may be re-inserted (66) within the outer envelope (42) via the slot (46). The sanitized cleaning head (26) may be reattached (68) to the baseplate (22) and reused in the future. In particular, the cleaning head (26) may be reattached (68) to the baseplate (22) by slidably inserting the first end (36) of the baseplate (22) inside the first pocket (32) of the cleaning head (26). The method (48) may further comprise slidably inserting the second end (38) of the baseplate (22) inside the second pocket (34) of the cleaning head (26). Thus, the first end (36) of the baseplate (22) snugly fitted inside the first pocket (32) of the cleaning head (26)—in cooperation with the second end (38) of the baseplate (22) snugly fitted inside the second pocket (34) of the cleaning head (26)—effectively attaches the cleaning head (26) to the ventral surface of the baseplate (22).

The bathroom cleaning device (10) of the present invention and method (48) of cleaning bathrooms are universally applicable to bathrooms, sinks, counters, showers, bathtubs, water fixtures, and toilets of all shapes and sizes, makes, models, and manufacturers. Furthermore, while intended for cleaning bathrooms, the cleaning device (10) of the present invention may be used for cleaning all areas of the house, business or public area. Although the invention has been described and illustrated with respect to preferred aspects thereof, it is not to be so limited since changes and modifications may be made therein which are within the full intended scope of the invention.

What is claimed is:

1. A bathroom cleaning kit, comprising:

an elongated arm having a proximal end and a distal end;

a handle attached to the proximal end of the elongated arm;

a joint attached to the distal end of the elongated arm;

a baseplate connected to the joint;

the baseplate comprising:

a) a substantially planar lower side and an opposite upper side;

b) a first end and an opposite second end;

c) a plurality of apertures traversing through the baseplate; and d) the plurality of apertures configured to permit liquid to pass through the baseplate;

a first cleaning head consisting of:

a) an outer envelope and an inner cleaning substrate;

b) the outer envelope having a ventral surface and a dorsal surface;

c) the outer envelope having a first end and an opposite second end;

d) a first pocket located at the first end on the dorsal surface of the outer envelope;

e) a second pocket located at the second end on the dorsal surface of the outer envelope;

f) the ventral surface of the outer envelope having a heavy duty cleaning pad;

g) the dorsal surface of the outer envelope having a light duty cleaning pad;

h) the first cleaning head being reversible by turning the first and second pockets inside out to form new first and second pockets;

i) two gripping loops designed to keep the cleaning head on a user's hand if used separate from the baseplate; and j) wherein the first cleaning head is washable and reusable;

the first cleaning head being removably attachable to the baseplate, comprising:

a) the first end of the baseplate configured to fit inside the first pocket of the first cleaning head;

b) the second end of the baseplate configured to fit inside the second pocket of the first cleaning head; and c) wherein the first end of the baseplate fitted inside the first pocket of the first cleaning head in cooperation with the second end of the baseplate fitted inside the second pocket of the first cleaning head removably attaches the first cleaning head to the baseplate; and wherein the first cleaning head is configured to be used attached to the baseplate or used separate from the baseplate to clean a bathroom.

2. The bathroom cleaning device of claim 1, the two gripping loops of the first cleaning head consisting of:

a) a right-hand thumb loop configured to extend snugly around a user's thumb of the right hand; and b) a left-hand thumb loop configured to extend snugly around a user's thumb of the left hand.

3. The bathroom cleaning kit of claim 1, wherein the inner cleaning substrate is removable from the outer envelope and replaceable.

4. The bathroom cleaning kit of claim 1, wherein the inner cleaning substrate is integrally formed and sealed within the outer envelope.

5. The bathroom cleaning kit of claim 1, wherein the outer envelope comprises at least one of cotton, microfiber, hemp and bamboo fabric.

6. The bathroom cleaning kit of claim 5, wherein the inner cleaning substrate comprises an anti-microbial sponge.

7. The bathroom cleaning kit of claim 2, the two gripping loops of the first cleaning head further consisting of:

the right-hand thumb loop located opposite the left-hand thumb loop across the width of the first cleaning head;

wherein the two gripping loops are formed of elastic material.

8. The bathroom cleaning kit of claim 1, further comprising:

additional cleaning heads that are different from the first cleaning head and adapted to clean particular areas of the bathroom;

the additional cleaning heads being removably attachable to the baseplate; and the additional cleaning heads being interchangeable with the first cleaning head and with one another on the baseplate.

9. The bathroom cleaning kit of claim 8, the additional cleaning heads comprising:

a) bristles;

b) a squeegee;

c) a scraper;

d) a scouring pad;

e) a polishing cover;

f) a stripping pad;

g) woven fabrics, nonwoven fabrics, or combinations thereof;

h) microfibers;

i) bamboo;

j) hemp;

k) impregnated disinfectants, cleaners, deodorizers, soaps, detergents, or combinations thereof; or l) a combination of any the foregoing.

10. The bathroom cleaning kit of claim 1, wherein the elongated arm is configured to extend and retract in length.

11. A bathroom cleaning kit, comprising:

an elongated arm having a proximal end and a distal end;

a handle attached to the proximal end of the elongated arm;

a joint attached to the distal end of the elongated arm;

a baseplate connected to the joint;

the baseplate comprising:

a) a substantially planar lower side and an opposite upper side;

b) a first end and an opposite second end;

c) a plurality of apertures traversing through the baseplate; and d) the plurality of apertures configured to permit liquid to pass through the baseplate;

a first cleaning head consisting of:

a) an outer envelope and an inner cleaning substrate;

b) the outer envelope having a ventral surface and a dorsal surface;

c) the outer envelope having a first end and an opposite second end;

d) a first pocket located at the first end on the dorsal surface of the outer envelope;

e) a second pocket located at the second end on the dorsal surface of the outer envelope;

f) the ventral surface of the outer envelope having a heavy duty cleaning pad;

g) the dorsal surface of the outer envelope having a light duty cleaning pad;

h) the first cleaning head being reversible by turning the first and second pockets inside out to form new first and second pockets;

i) two gripping loops designed to keep the cleaning head on a user's hand if used separate from the baseplate;

j) the two gripping loops being a right-hand thumb loop configured to extend snugly around a user's thumb of the right hand and a left-hand thumb loop configured to extend snugly around a user's thumb of the left hand; and k) wherein the first cleaning head is washable and reusable;

the first cleaning head being removably attachable to the baseplate, comprising:

a) the first end of the baseplate configured to fit inside the first pocket of the first cleaning head;

b) the second end of the baseplate configured to fit inside the second pocket of the first cleaning head; and c) wherein the first end of the baseplate fitted inside the first pocket of the first cleaning head in cooperation with the second end of the baseplate fitted inside the second pocket of the first cleaning head removably attaches the first cleaning head to the baseplate; and wherein the first cleaning head is configured to be used attached to the baseplate or used separate from the baseplate to clean a bathroom.

12. The bathroom cleaning kit of claim 11, further comprising:

additional cleaning heads that are different from the first cleaning head and adapted to clean Particular areas of the bathroom;

the additional cleaning heads being removably attachable to the baseplate;

the additional cleaning heads being interchangeable with the first cleaning head and with one another on the baseplate;

the additional cleaning heads comprising:

a) bristles;

b) a squeegee;

c) a scraper;

d) a scouring pad;

e) a polishing cover;

f) a stripping pad;
g) woven fabrics, nonwoven fabrics, or combinations thereof;
h) microfibers;
i) bamboo;
j) hemp;
k) impregnated disinfectants, cleaners, deodorizers, soaps, detergents, or combinations thereof; or
l) a combination of any the foregoing.

13. The bathroom cleaning kit of claim 11, wherein the right-hand thumb loop is located opposite the left-hand thumb loop across the width of the first cleaning head; and wherein the two gripping loops are formed of elastic material.

14. The bathroom cleaning kit of claim 11, wherein the inner cleaning substrate is integrally formed and sealed within the outer envelope.

15. The bathroom cleaning kit of claim 11, wherein the inner cleaning substrate is removable from the outer envelope and replaceable.

16. The bathroom cleaning kit of claim 11, wherein the elongated arm is configured to extend and retract in length using telescoping extensions.

17. A bathroom cleaning kit, comprising:
an elongated arm having a proximal end and a distal end;
a handle attached to the proximal end of the elongated arm;
a joint attached to the distal end of the elongated arm;
a baseplate connected to the joint the baseplate comprising:
a) a substantially planar lower side and an opposite upper side;
b) a first end and an opposite second end;
c) a plurality of apertures traversing through the baseplate; and
d) the plurality of apertures configured to permit liquid to pass through the baseplate;
a first cleaning head consisting of:
a) an outer envelope and an inner substrate;
b) the outer envelope having a ventral surface and a dorsal surface;
c) the outer envelope having a first end and an opposite second end;
d) a first pocket located at the first end on the dorsal surface of the outer envelope;
e) a second pocket located at the second end on the dorsal surface of the outer envelope;
f) the ventral surface of the outer envelope having a heavy duty cleaning pad;
g) the dorsal surface of the outer envelope having a light duty cleaning pad;
h) the first cleaning head being reversible by turning the first and second pockets inside out to form new first and second pockets;
i) two gripping loops designed to keep the cleaning head on a user's hand if used separate from the baseplate;
j) the two gripping loops being a right-hand thumb loop configured to extend snugly around a user's thumb of the right hand and a left-hand thumb loop configured to extend snugly around a user's thumb of the left hand;
k) wherein the right-hand thumb loop is located opposite the left-hand thumb loop across the width of the first cleaning head;
l) wherein the two gripping loops are formed of elastic material; and
m) wherein the first cleaning head is washable and reusable;
the first cleaning head being removably attachable to the baseplate, comprising:
d) the first end of the baseplate configured to fit inside the first pocket of the first cleaning head;
e) the second end of the baseplate configured to fit inside the second pocket of the first cleaning head; and
f) wherein the first end of the baseplate fitted inside the first pocket of the first cleaning head in cooperation with the second end of the baseplate fitted inside the second pocket of the first cleaning head removably attaches the first cleaning head to the baseplate; and
wherein the first cleaning head is configured to be used attached to the baseplate or used separate from the baseplate to clean a bathroom.

18. The bathroom cleaning kit of claim 17, further comprising:
additional cleaning heads that are different from the first cleaning head and adapted to clean Particular areas of the bathroom;
the additional cleaning heads being removably attachable to the baseplate;
the additional cleaning heads being interchangeable with the first cleaning head and with one another on the baseplate;
the additional cleaning heads comprising:
a) bristles;
b) a squeegee;
c) a scraper;
d) a scouring pad;
e) a polishing cover;
f) a stripping pad;
g) woven fabrics, nonwoven fabrics, or combinations thereof;
h) microfibers;
i) bamboo;
j) hemp;
k) impregnated disinfectants, cleaners, deodorizers, soaps, detergents, or combinations thereof; and
l) a combination of any the foregoing.

* * * * *